United States Patent [19]

Yamanaka et al.

[11] 4,166,476

[45] Sep. 4, 1979

[54] VACUUM CUT-OFF VALVE

[75] Inventors: Minoru Yamanaka, Toyota; Yasuhiro Kawabata, Anjo, both of Japan

[73] Assignee: Aisin Seiki Kabushiki Kaisha, Aichi, Japan

[21] Appl. No.: 822,550

[22] Filed: Aug. 8, 1977

[30] Foreign Application Priority Data

Aug. 9, 1976 [JP] Japan ..... 51-95150

[51] Int. Cl.[2] ..... F02P 5/10

[52] U.S. Cl. ..... 137/103; 137/627.5; 137/DIG. 8; 60/290; 123/117 A

[58] Field of Search ..... 137/107, 103, DIG. 8, 137/102, 627.5; 60/290; 123/117 A

[56] References Cited

U.S. PATENT DOCUMENTS

| | | | |
|---|---|---|---|
| 2,652,847 | 9/1953 | Segebarth | 137/103 |
| 3,055,678 | 9/1962 | Alfieri | 137/627.5 |
| 3,766,933 | 10/1973 | Nicholson, Jr. | 137/DIG. 8 |
| 3,921,666 | 11/1975 | Leiber | 137/627.5 |
| 3,933,166 | 1/1976 | Gould et al. | 123/117 A |
| 3,948,045 | 4/1976 | Budinski et al. | 60/306 |
| 3,955,364 | 5/1976 | Lewis | 123/117 A |
| 3,996,955 | 12/1976 | Kawabata | 123/117 A |
| 4,033,125 | 7/1977 | Inada et al. | 137/103 |
| 4,050,423 | 9/1977 | Inada et al. | 123/117 A |
| 4,052,996 | 10/1977 | Burrus | 137/627.5 |
| 4,064,894 | 12/1977 | Ludwig | 123/117 A |

FOREIGN PATENT DOCUMENTS

| | | | |
|---|---|---|---|
| 888516 | 12/1971 | Canada | 123/117 A |

*Primary Examiner*—William R. Cline
*Assistant Examiner*—H. Jay Spiegel
*Attorney, Agent, or Firm*—Oblon, Fisher, Spivak, McClelland & Maier

[57] ABSTRACT

A vacuum cut-off valve for cutting off vacuum communication between an inlet port and an outlet port when the inlet vacuum increases above a predetermined vacuum level so that the outlet vacuum is maintained at a constant predetermined vacuum level. When the valve cutting operation between the inlet port and the outlet port is insufficient and vacuum leakage results, atmospheric pressure is admitted to the outlet port to thereby maintain the outlet vacuum at the constant predetermined level.

9 Claims, 2 Drawing Figures

VACUUM CUT-OFF VALVE

BACKGROUND OF THE INVENTION

This invention relates generally to valves, and more particularly to vacuum cut-off valves for maintaining an outlet vacuum at a constant predetermined vacuum level when an inlet vacuum increases above a predetermined vacuum level.

A vacuum cut-off valve normally maintains an outlet vacuum at a constant predetermined vacuum level by means of cutting off the vacuum communication between an inlet port and an outlet port when the inlet vacuum increases above the predetermined vacuum level. However, it is so difficult in the conventional vacuum cut-off valve to completely cut off the vacuum communication between the inlet port and the outlet port since the vacuum leaks in a valve means interposed between the inlet port and the outlet port. Consequently, the outlet vacuum cannot be maintained at the constant predetermined vacuum level.

SUMMARY OF THE INVENTION

It is, therefore, a principal object of this invention to provide an improved vacuum cut-off valve dependably maintaining an outlet vacuum at a constant predetermined vacuum level when an inlet vacuum increases above the predetermined vacuum level.

It is another object of this invention to provide a vacuum cut-off valve including means for compensating the output vacuum by means of connecting the output vacuum to atmospheric pressure so as to prevent the output vacuum from increasing when the inlet vaccum increases above the predetermined vacuum level.

It is a further object of this invention to provide a vacuum cut-off valve which is reliable in operation, simple in construction and which may be easily assembled and adjusted to provide the constant predetermined vacuum level.

Additional objects and features of this invention will become apparent from the following description in which the preferred embodiment has been set forth in detail in conjunction with the accompanying drawings.

BRIEF DESCRIPTION OF THE DRAWINGS

Various other objects, features and attendant advantages of the present invention will be more fully appreciated as the same becomes better understod from the following detailed description when considered in connection with the accompanying drawings in which like reference characters designate like or corresponding parts throughout the several views, and wherein.

DETAILED DESCRIPTION OF THE PREFERRED EMBODIMENTS

Figure 1:
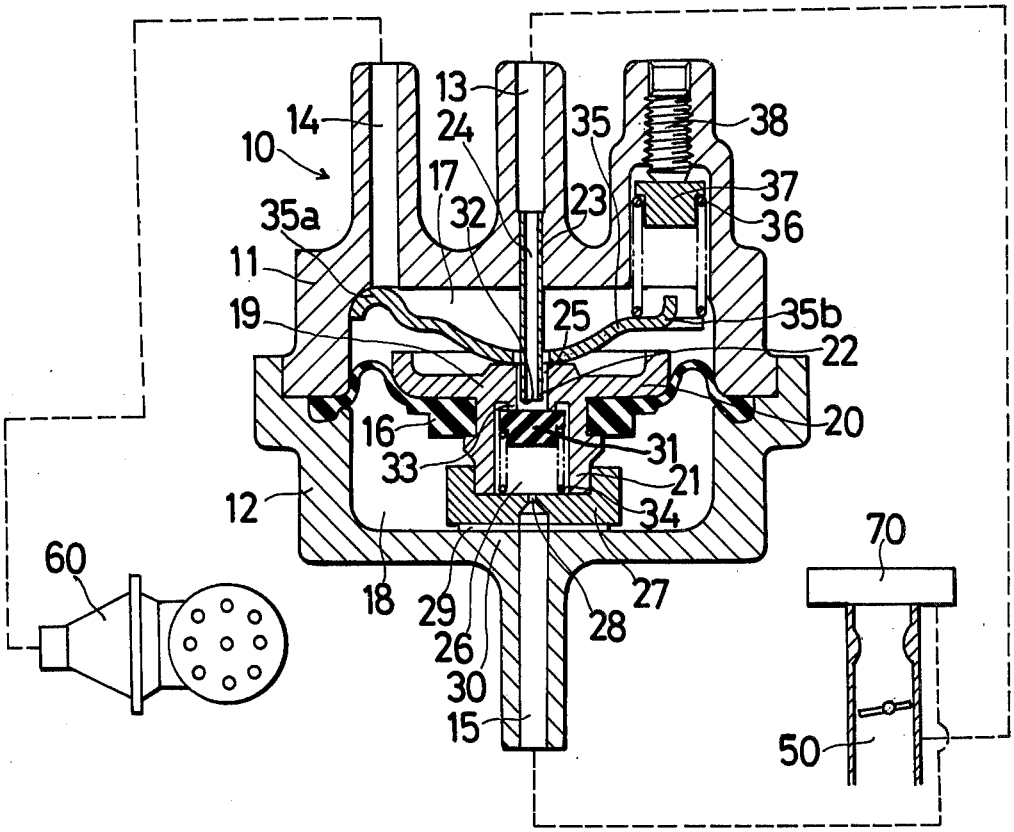
FIG. 1 is a vertical sectional view of the vacuum cut-off valve in accordance with this invention incorporated in a spark timing control system of the internal combustion engine.

Referring now more particularly to FIG. 1, a vacuum cut-off valve 10 of the present invention includes an upper body member 11 and a lower body member 12, which are combined with each other by a suitable connecting means. The upper body member 11 has an inlet port 13 for connection to a vacuum source, such as an intake manifold 50 in the internal combustion engine, and an outlet port 14 for connection to a suitable vacuum utilization device, such as a vacuum servo-controlled distributor 60. The lower body member 12 has an air port 15 for connection to a source of atmospheric pressure, such as an air cleaner 70.

An annular flexible diaphragm 16 is rigidly secured at the outer periphery thereof between the body members 11 and 12. The diaphragm 16 is fabricated from rubber or other suitable flexible materials and is responsive to the change in vacuum level within the body members 11 and 12. The interior of the body members 11 and 12 is divided into a first chamber 17 and a second chamber 18 by the diaphragm 16. The outlet port 14 communicates with the first chamber 17, and the air port 15 communicates with the second chamber 18. The diaphragm 16 is secured at the inner periphery thereof to pressure plate 19 which is provided with a flange 20, a hollow stem 21, and an axial hole 22. A pipe 23 secured to the upper body member 11 is provided with a penetrating hole 24 therethrough. The upper end of the pipe 23 communicates with the inlet port 13, while the lower end of the pipe 23 extends into the axial hole 22 of the pressure plate 19.

A gap 25 is provided between the axial hole 22 of the pressure plate 19 and the outer peripheral surface of the pipe 23 in order to establish the communication between the inlet port 13 and the first chamber 17. A small chamber 26 is defined by the hollow stem 21 of the pressure plate 19. The open end of the small chamber 26 is enclosed by means of a cover plate 27 having an axial orifice passageway 28. The small chamber 26 continuously communicates with the second chamber 18 through the orifice passageway 28. The cover plate 27 is provided with radial passageways 29 so as to permit permanent communication between the air port 15 and the second chamber 18 even when the cover plate 27 is contact with a bottom 30 of the lower body member 12.

A poppet valve 31 is positioned within the small chamber 26 so as to be in sealing contact with a first valve seat 32 at the tip end surface of the pipe 23, and with a second valve seat 33 on the hollow stem 21 projecting into the small chamber 26. The valve 31 controls fluid communication between the inlet port 13 and the first chamber 17, and also controls the fluid communication between the small chamber 26 and the first chamber 17. A relatively weak coil spring 34 is interposed between the cover plate 27 and the valve 31 so as to urge the valve 31 to engage with the first or the second valve seat 32 or 33.

Within the first chamber 17 is positioned a resilient rectangular plate 35 mounted on the pressure plate 19. One end 35*a* of the resilient plate 35 is in contact with the upper body member 11, while the other end 35*b* of the resilient plate 35 is in contact with a coil spring 36. That is to say, the coil spring 36 is interposed between the resilient plate 35 and a spring cap 37 so as to bias the resilient plate 35 as well as the pressure plate pressure plate 19 downward thereby bringing the valve 31 to be seated on the second valve seat 33. The coil spring 36 is adjustable by rotating a screw 38 to vary the degree of the compression loading of the spring 36.

In operation, when the vacuum in the inlet port 13 is at zero inches of mercury, as in FIG. 1, the pressure plate 19 secured to the diaphragm 16 is biased downward by the force of the spring 36 and is in the normal or rest position, wherein the valve 31 is spaced from the first valve seat 32 and is seated on the second valve seat 33. Accordingly, communication between the inlet port 13 and the first chamber 17 is established, while the communication between the first chamber 17 and the small chamber 26 is interrupted.

As the inlet vacuum increases from zero inches of mercury, the inlet vacuum enters the first chamber 17. That is to say, the outlet vacuum increases in proportion to the inlet vacuum as shown at the line X in FIG. 2. As the inlet vacuum increases the pressure plate 19 is moved upward, overcoming the biasing force of the spring 36.

When the inlet vacuum reaches the predetermined vacuum level, the valve 31 is disposed in sealing contact with the first valve seat 32, maintaining the sealing contact with the second valve seat 33. As the result, the first chamber 17 is interrupted from communication with the inlet port 13, to thereby cut off the vacuum entering the first chamber 17. Accordingly, even if the inlet vacuum increases above the predetermined vacuum level, the outlet vacuum is maintained at the constant predetermined vacuum level as shown at the line Y in FIG. 2.

Under this condition, if a vacuum leak occurs between the valve 31 and the first valve seat 32 and enters the first chamber 17, the pressure plate 19 moves further upward. As a result, the valve 31 is released from the second valve seat 33, maintaining the sealing contact with the first valve seat 32. Therefore, the atmospheric pressure is transmitted into the first chamber 17 from the small chamber 26. Accordingly, the vacuum in the outlet port 14 communicating with the first chamber 17 is maintained at the constant predetermined vacuum level as indicated by the line Y in FIG. 2. That is to say, the second valve seat 33 is used for the purpose of compensating the output vacuum by means of connecting the output vacuum to the atmospheric pressure.

Figure 2:
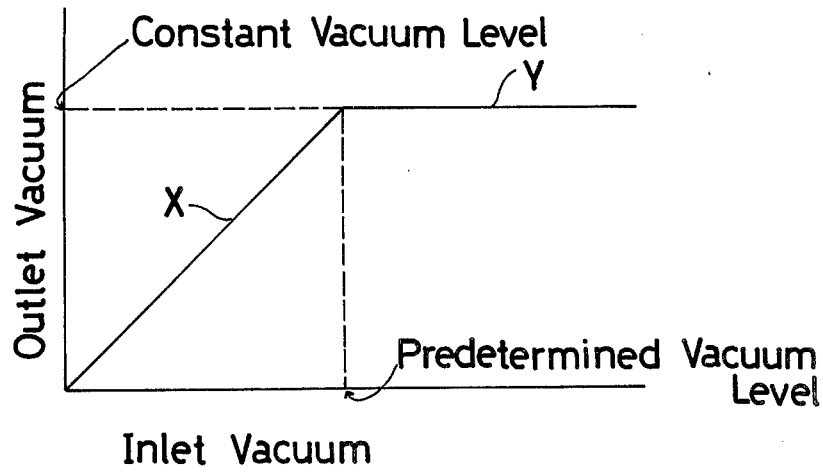
FIG. 2 is a graph showing the operating characteristics of the vacuum cut-off valve in FIG. 1, wherein the abscissa and the ordinate indicate the inlet vacuum and the outlet vacuum, respectively.

Moreover, when the vacuum in the first chamber 17 decreases below the predetermined vacuum level, the valve 31 is released from the first valve seat 32, whereby the inlet vacuum enters the first chamber 17, to thereby keep the outlet vacuum at the constant level as indicated by the line Y in FIG. 2.

It will be apparent to those skilled in the art that the valve of the invention may be constructed in a variety of ways without, however, departing from the scope and spirit of the appended claims.

What is claimed as new and desired to be secured by letters patent of the United States is:

1. A vacuum cut-off which comprises:

a body member member having an inlet port for connection to a vacuum source, an outlet port for connection to a vacuum utilization device, and an air port connected to a source of atmospheric pressure;

a flexible diaphragm for dividing the interior of said body member into a first chamber communicating with said outlet port and a second chamber communicating with said air port;

first valve means for controlling fluid communication between said inlet port and said first chamber by the movement of said diaphragm;

second valve means for controlling fluid communication between said first chamber and said second chamber by the movement of said diaphragm;

a pipe associated with said inlet port and provided with a tip end acting as a first seat of said first valve means;

a pressure plate made integral with said diaphragm and provided with a projection acting as a second seat of said second valve means and an axial hole within which said pipe is coaxially disposed wherein said pressure plate is provided with a small air chamber continuously communicated to said second chamber through an orifice passageway formed in said air chamber; and regulating means located in said first chamber and operatively connected to said diaphragm whereby said first valve is kept open while said second valve is kept closed before the inlet vacuum reaches a predetermined level, said diaphragm being movable due to the increase of the inlet vacuum whereby said first valve is closed when the inlet vacuum reaches the predetermined level, wherein said second valve is opened when vacuum in said second chamber increases above the predetermined level.

2. A vacuum cut-off valve according to claim 1 wherein said first and second valve means comprise a single and common valve located within said air chamber and normally urged to seat on said first and second seats.

3. A vacuum cut-off valve according to claim 1 further comprising a resilient plate mounted on said pressure plate and engaged with said regulating means.

4. A vacuum cut-off valve according to claim 3 wherein said regulating means comprises a coil spring, and means for varying the degree of the compression loading of said coil spring.

5. A vacuum cut-off valve according to claim 1 which further comprises:

a plate member disposed in said second chamber forming a wall portion of said air chamber; and said orifice passageway including passage means provided in said plate member for continuously communicating said air chamber with said second chamber.

6. A vacuum cut-off valve according to claim 4 which further comprises:

a plate member disposed in said second chamber forming a wall portion of said air chamber; and said orifice passageway including passage means provided in said plate member for continuously communicating said air chamber with said second chamber.

7. A vacuum cut-off valve according to claim 1 which further comprises:

said second valve means being disposed in said air chamber; and means disposed in said air chamber for biasing said valve means to said first and second seats.

8. A vacuum cut-off valve according to claim 5 which further comprises:

said second valve means being diposed in said air chamber; and means disposed in said air chamber for biasing said valve means to said first and second seats.

9. A vacuum cut-off valve according to claim 8 wherein said means disposed in said air chamber comprises a spring member engaging said valve means and said plate member.

* * * * *